US006698589B1

(12) United States Patent
Johnson

(10) Patent No.: US 6,698,589 B1
(45) Date of Patent: Mar. 2, 2004

(54) CONTAINER FOR HOLDING ROLLS OF WRAPPING PAPER

(76) Inventor: Earma Johnson, 2 Greens Ferry Ct., Durham, NC (US) 27713

( * ) Notice: Subject to any disclaimer, the term of this patent is extended or adjusted under 35 U.S.C. 154(b) by 74 days.

(21) Appl. No.: 09/670,929

(22) Filed: Sep. 28, 2000

(51) Int. Cl.[7] ..... B65D 85/66

(52) U.S. Cl. ..... 206/391; 206/395; 206/408

(58) Field of Search ..... 206/390, 391, 206/395, 397, 405, 486, 446, 427, 303, 225, 223, 579, 242, 250, 256; 229/162, 117.09, 117.12, 117.13, 117.16, 117.17, 87.01, 87.19, 120.08; 211/65, 60.1, 70.01, 73; 220/528

(56) References Cited

U.S. PATENT DOCUMENTS 2,756,895 A * 7/1956 Enders ..... 206/242
3,624,776 A * 11/1971 Gordon ..... 206/521
3,987,892 A * 10/1976 Killy ..... 206/443
4,037,777 A * 7/1977 Maughan ..... 229/117.16
4,088,262 A * 5/1978 Kuehlhorn ..... 206/194
4,369,929 A * 1/1983 Cayer ..... 206/225
4,941,624 A * 7/1990 Schuster ..... 229/117.13
4,969,595 A * 11/1990 Teasdale ..... 229/117.17
4,981,232 A * 1/1991 Wynn ..... 220/23.83
5,577,614 A * 11/1996 Palmeroni, Jr. et al. .... 206/521
5,609,248 A * 3/1997 Rohrbough et al. ..... 206/216
6,123,197 A * 9/2000 Marquez et al. ..... 206/575

* cited by examiner

*Primary Examiner*—Shian Luong
(74) *Attorney, Agent, or Firm*—Coats & Bennett, P.L.L.C.

(57) ABSTRACT

A container is provided for receiving and holding individual rolls of wrapping paper. The container includes a surrounding sidewall structure, a bottom and an open top. Provided over the open top is an insert panel that includes a series of openings. Each opening is sized to receive and hold a roll of wrapping paper. Individual rolls of wrapping paper is stored within the container by inserting the rolls into and through the openings formed in the insert panel such that the individual rolls are extended inwardly into the confines of the container.

4 Claims, 2 Drawing Sheets

CONTAINER FOR HOLDING ROLLS OF WRAPPING PAPER

FIELD OF INVENTION

The present invention relates to containers and more particularly to a container for holding and storing individual rolls of wrapping paper.

BACKGROUND OF THE INVENTION

Special occasions such as birthdays, anniversaries, graduations, and the Christmas season calls for the wrapping of presents. It is not uncommon for a household to have many different rolls of wrapping paper for such occasions. In fact, it is not uncommon to find rolls of wrapping paper stored or placed in various locations throughout a household. Not only is the wrapping paper sometimes hard to locate, but it is also a concern that all of the wrapping paper is not located in one single location where it can be viewed before a wrapping paper is selected for a certain package. Further, the wrapping paper usually becomes damaged as a result of not being stored in a sturdy container.

Therefore, there has been and continues to be a need for a system for organizing individual rolls of wrapping paper and storing them in one single facility or container such that access and viewing will be convenient.

SUMMARY OF THE INVENTION

The present invention entails a container for holding and storing individual rolls of wrapping paper. The container includes a side structure and an internal area defined therein. The container includes an insert panel having a series of openings formed therein. Each opening is particularly sized to receive an individual roll of wrapping paper. Thus a series of wrapping paper rolls can be inserted through the openings of the insert panel such that a substantial length of each roll is confined within the container.

In a particular embodiment of the present invention, the container includes a surrounding side wall structure, a closed end, and an inlet end formed on the container opposite the closed end through which rolls of wrapping paper are inserted. The inlet end includes a support panel or an insert panel having a series of openings formed therein. Each opening is particularly sized to receive a roll of wrapping paper. Thus a series of wrapping paper rolls can be inserted into and through the openings within the support or insert panel such that a substantial length of each individual roll lies within the confines of the container while a relatively short portion of each roll may lie exteriorly of the support or insert panel. It is thus appreciated that the support panel or the insert panel maintains the individual rolls of wrapping paper separated in the area where the rolls extend through the support or insert panel.

Other objects and advantages of the present invention will become apparent and obvious from a study of the following description and the accompanying drawings which are merely illustrative of such invention.

DETAILED DESCRIPTION OF THE INVENTION

Figure 1:
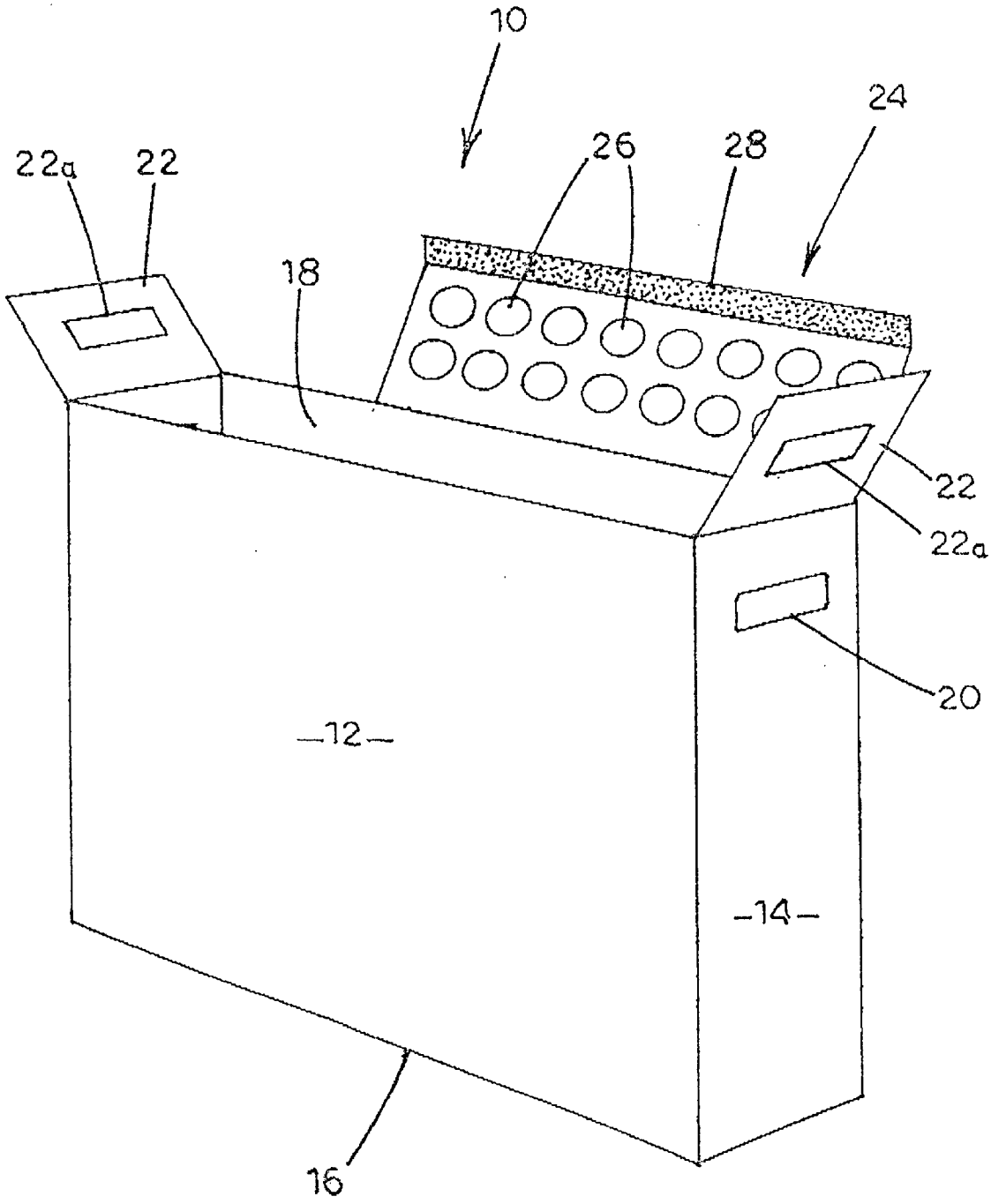
FIG. 1 is a perspective view of the container for holding rolls of wrapping paper with the container being shown in an open and partially unassembled position.

With further reference to the drawings, a container for holding and storing a series of individual rolls of wrapping paper WP is shown therein and indicated generally by the numeral 10. Container 10 may be constructed of various materials such as corrugated board, plastic, metal, or any other suitable material. As will be appreciated from subsequent portions in this disclosure, container 10 is designed and adapted to receive mutli-rolls of wrapping paper and to hold and store the rolls of wrapping paper in a convenient location.

Now viewing the container 10 in more detail, it is seen that the container shown in the drawings is somewhat elongated from edge to edge. However, the shape and size of the container 10 can vary. Viewing the container 10 in more detail, it is seen that the same includes a surrounding side wall structure. More particularly, this surrounding side wall structure includes a pair of opposed sides 12 and a pair of opposed edges 14. In the case of the embodiment disclosed herein, the opposed sides 12 join the opposed edges 14 at 90 degree angles.

Formed on one end of the container 10 is a closure panel that is referred to herein as bottom 16. Bottom 16 essentially closes one end of the container.

Formed about the container 10 opposite bottom 16 is an open top 18. As will be appreciated from subsequent portions of this disclosure, the open top is designed to receive a closure panel that includes openings formed therein for receiving and holding individual rolls of wrapping paper.

Formed in each edge 14 is a hand opening 20. Secured to the top portion of each edge 16 is a hand flap 22. Hand flap 22 includes an opening 22*a*. Once the container 10 is assembled for use, the hand flaps 22 are folded inwardly and secured to the inner side of the respective edges 14. When this is done, the openings 22*a* of the hand flaps 22 align with the hand openings 20 formed in the edges 14. Thus, a reinforced hand opening is formed that permits the container 10 to be easily handled and carried. Also, it is appreciated that the flaps 22 could be provided with means that secure them to the inner side of the edges 14. For example, the flaps 22 could be provided with peel off adhesive strips that when peeled off would permit the flaps to be glued to the inner side of the respective edges 14.

Figure 2:
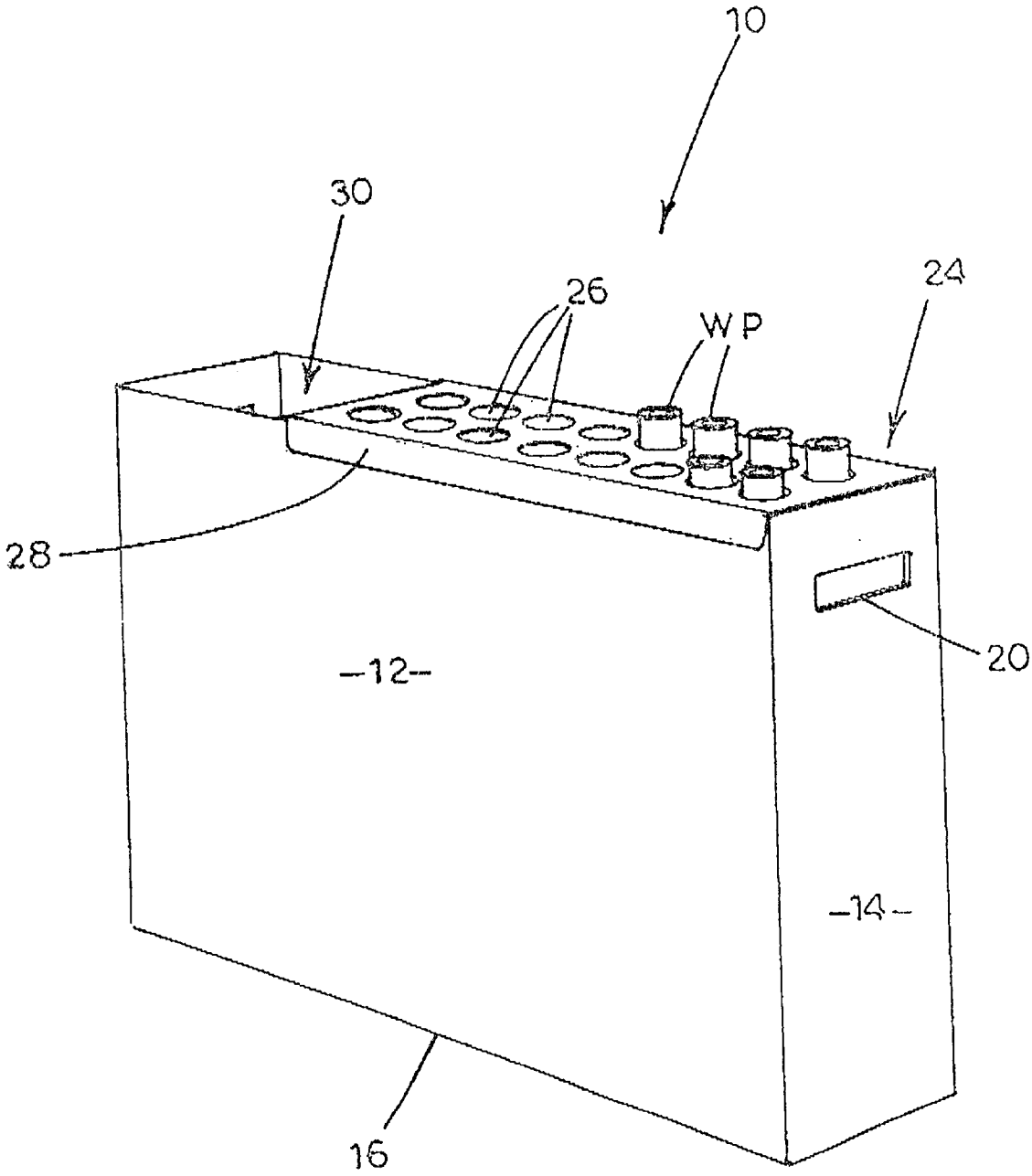
FIG. 2 is a perspective view of the container for holding or storing individual rolls of wrapping paper with the container being shown in an assembled position.

Secured to the end portion of the container 10 opposite the bottom 16 is a panel indicated generally by the numeral 24. Panel 24 is sometimes referred to as a support panel or an insert panel and includes a series of openings 26. As seen in FIGS. 1 and 2, the openings 26 are disposed in two rows. Each opening 26 is particularly sized to receive a standard roll of wrapping paper. The panel 24 includes an attaching or connecting edge 28. Attaching edge 28 is generally provided with some means to secure the panel 24 to the container. In one preferred embodiment, the attaching edge 28 would be provided with an adhesive strip that enables the attaching edge 28 to be secured to the upper edge portion of an opposed side 12, as illustrated in FIG. 2.

As noted above, the panel 24 is connected to the upper edge of one side 12. In an assembled position, as shown in FIG. 2, the panel 24 is folded over to cover a portion of the open top 18 of the container. The attaching edge 28 is secured to the upper edge of the adjacent side 12. Now it is appreciated that a series of rolls of wrapping paper WP can be inserted downwardly, as viewed in FIG. 2, through the respective openings 26 such that a substantial length of each roll is confined interiorly within the container 10. The length of the container can be adjusted such that a portion of the respective rolls of wrapping paper WP would extend outwardly past the exterior surface of the panel 24.

In the case of the embodiment illustrated herein, the panel 24 is sized so as to leave a portion of the open top 18 exposed. This results in the container including an auxiliary or side storage compartment which is indicated generally by the numeral 30 in FIG. 2. That is, material such as bows, ribbons, cards and the like can be stored in the container 10 by simply using the side storage compartment 30 shown in FIG. 2.

From the foregoing specification and discussion, it is appreciated that the container 10 of the present invention is specifically designed to accept, hold and store individual rolls of wrapping paper. The container maintains the individual rolls in a compact, organized fashion such that an individual can easily review and see what wrapping paper is available and can make his or her choice of wrapping paper based on the rolls that are held and stored within the container.

Further, the container 10 of the present invention is quite economical to manufacture and can be presented and sold to the consumer at a reasonable price.

The present invention may, of course, be carried out in other specific ways than those herein set forth without departing from the scope and the essential characteristics of the invention. The present embodiments are therefore to be construed in all aspects as illustrative and not restrictive and all changes coming within the meaning and equivalency range of the appended claims are intended to be embraced therein.

What is claimed is:

1. A method of storing and holding individual rolls of wrapping paper comprising: forming a container having a surrounding side structure and an opening formed therein; placing an insert panel over the opening, the insert panel including a series of openings with each opening being sized to receive a roll of wrapping paper; inserting a plurality of individual rolls of wrapping paper through the openings of the insert panel and into the container.

2. The method of claim 1 wherein the insert panel separates the individual rolls of wrapping paper in the area of the insert panel.

3. The method of claim 1 wherein the insert panel is foldable to a position over the opening formed in the container and once extending over the opening, the insert panel is securable to the container such that the insert panel with the individual openings formed therein forms an exterior panel of the container.

4. The method of claim 1 wherein the container includes a pair of opposed sides and an open top and wherein the method includes foldably connecting the insert panel to one side of the container, extending the insert panel over and across the open top of the container and securing a terminal edge of the insert panel to the side of the container opposite the side where the insert panel is foldably connected.

* * * * *